US011574615B2

(12) United States Patent
Takata

(10) Patent No.: US 11,574,615 B2
(45) Date of Patent: Feb. 7, 2023

(54) KEYBOARD APPARATUS AND LOAD APPLICATION METHOD

(71) Applicant: Roland Corporation, Shizuoka (JP)

(72) Inventor: Yukihide Takata, Shizuoka (JP)

(73) Assignee: Roland Corporation, Shizuoka (JP)

( * ) Notice: Subject to any disclaimer, the term of this patent is extended or adjusted under 35 U.S.C. 154(b) by 0 days.

(21) Appl. No.: 17/496,794

(22) Filed: Oct. 8, 2021

(65) Prior Publication Data

US 2022/0130351 A1 Apr. 28, 2022

(30) Foreign Application Priority Data

Oct. 27, 2020 (JP) ..... JP2020-179836

(51) Int. Cl.
*G10C 1/00* (2006.01)

(52) U.S. Cl.
CPC ..... *G10C 1/00* (2013.01)

(58) Field of Classification Search
CPC ..... G10C 1/00
See application file for complete search history.

(56) References Cited

U.S. PATENT DOCUMENTS 3,903,780 A * 9/1975 Aliprandi ..... G10C 3/12 84/433
4,476,769 A * 10/1984 Kumano ..... G10C 3/12 984/61
4,933,807 A * 6/1990 Duncan ..... G10H 1/344 984/317
5,136,915 A * 8/1992 Shibukawa ..... G10C 3/20 84/626
5,249,497 A * 10/1993 Niitsuma ..... G10C 3/12 84/247
5,286,915 A * 2/1994 Komano ..... G10H 5/007 84/661
7,582,821 B2 * 9/2009 Watanabe ..... G10C 3/12 84/423 R
7,667,116 B2 * 2/2010 Yamashita ..... G10H 1/346 84/20
7,919,708 B2 * 4/2011 Komatsu ..... G10H 1/346 84/746
8,093,480 B2 * 1/2012 Yoshida ..... G10H 1/346 84/439
8,648,236 B2 * 2/2014 Hayashi ..... G10C 3/12 84/243
8,785,759 B2 * 7/2014 Iwase ..... G10H 1/18 84/649

(Continued)

FOREIGN PATENT DOCUMENTS

JP 2020060652 4/2020

*Primary Examiner* — Robert W Horn
(74) *Attorney, Agent, or Firm* — JCIPRNET

(57) ABSTRACT

Provided is a keyboard apparatus including: a hammer, having a mass body on one end side, rotating in a first direction by being pushed on the other end side when a key is pressed; and a load application member, applying, to the hammer, at least one of a first load directed in the first direction and a second load directed in a second direction opposite the first direction. The first load is a load that gradually increases as approaching a terminal position of the key in key pressing. The second load is a load that gradually decreases as approaching the terminal position.

20 Claims, 7 Drawing Sheets

(56) References Cited

U.S. PATENT DOCUMENTS

| | | | | |
|---|---|---|---|---|
| 8,809,658 | B2 * | 8/2014 | Osuga | G10H 1/346 84/439 |
| 8,889,975 | B2 * | 11/2014 | Komatsu | G10H 1/346 84/439 |
| 9,006,549 | B2 * | 4/2015 | Suzuki | G10H 1/346 84/423 R |
| 9,607,587 | B2 * | 3/2017 | Suzuki | G10B 3/12 |
| 10,580,390 | B2 * | 3/2020 | Akaishi | G10C 3/12 |
| 10,714,067 | B1 * | 7/2020 | Xu | G10H 1/0066 |
| 10,762,884 | B2 * | 9/2020 | Suzuki | G10C 3/12 |
| 10,891,929 | B2 * | 1/2021 | Yamamoto | G10B 3/12 |
| 10,902,830 | B2 * | 1/2021 | Nishida | G10H 1/46 |
| 10,991,351 | B2 * | 4/2021 | Sato | G10C 3/12 |
| 11,017,749 | B2 * | 5/2021 | Tsuzuku | G10H 1/346 |
| 11,107,449 | B2 * | 8/2021 | Sato | G10H 1/346 |
| 11,176,916 | B2 * | 11/2021 | Yamamura | G10H 1/34 |
| 11,183,162 | B2 * | 11/2021 | Takahashi | G10H 1/344 |
| 11,289,060 | B2 * | 3/2022 | Takata | G10H 1/181 |
| 2015/0090104 | A1 * | 4/2015 | Osuga | G10H 1/34 84/744 |
| 2020/0111464 | A1 * | 4/2020 | Yamamura | G10C 3/12 |
| 2022/0130351 | A1 * | 4/2022 | Takata | G10C 3/12 |
| 2022/0293068 | A1 * | 9/2022 | Suzuki | G10H 1/346 |

* cited by examiner

KEYBOARD APPARATUS AND LOAD APPLICATION METHOD

CROSS-REFERENCE TO RELATED APPLICATIONS

This application claims the priority benefit of Japan Application No. 2020-179836, filed on Oct. 27, 2020. The entirety of the above-mentioned patent application is hereby incorporated by reference herein and made a part of this specification.

BACKGROUND

Technical Field

The disclosure relates to a keyboard apparatus, particularly to a keyboard apparatus and a load application method in which a good key pressing feel can be given.

Related Art

Patent Document 1 discloses a keyboard apparatus, in which a hammer is rotated in conjunction with rotation of a key during key pressing, and a load (reaction force that pushes up the key) that acts on the key as the hammer is rotated is utilized to give a performer a feel of pressing a key. According to this kind of keyboard apparatus, by increasing or decreasing the mass of the hammer (mass body), the load that acts on the key during key pressing, that is, the feel of pressing a key, can be changed.

PATENT DOCUMENTS

Patent Document 1: Japanese Laid-open No. 2020-060652 (for example, in paragraph 0029 and FIG. 3)

However, in the related art, since the load that acts on the key as the hammer is rotated does not change much from an initial position until a terminal position in key pressing, there is a problem that a good key pressing feel cannot be given.

The disclosure provides a keyboard apparatus and a load application method in which a good key pressing feel can be given.

SUMMARY

A keyboard apparatus of the disclosure includes: a hammer, having a mass body on one end side, rotating in a first direction by being pushed on the other end side when a key is pressed; and a load application member, applying, to the hammer, at least one of a first load directed in the first direction and a second load directed in a second direction opposite the first direction. The first load is a load that gradually increases as approaching a terminal position of the key in key pressing. The second load is a load that gradually decreases as approaching the terminal position.

A load application method of the disclosure is for a keyboard apparatus. The keyboard apparatus includes: a hammer, having a mass body on one end side, rotating in a first direction by being pushed on the other end side when a key is pressed; and a load application member, applying, to the hammer, at least one of a first load directed in the first direction and a second load directed in a second direction opposite the first direction. The first load is a load that gradually increases as approaching a terminal position of the key in key pressing. The second load is a load that gradually decreases as approaching the terminal position.

DESCRIPTION OF THE EMBODIMENTS

Figure 1:
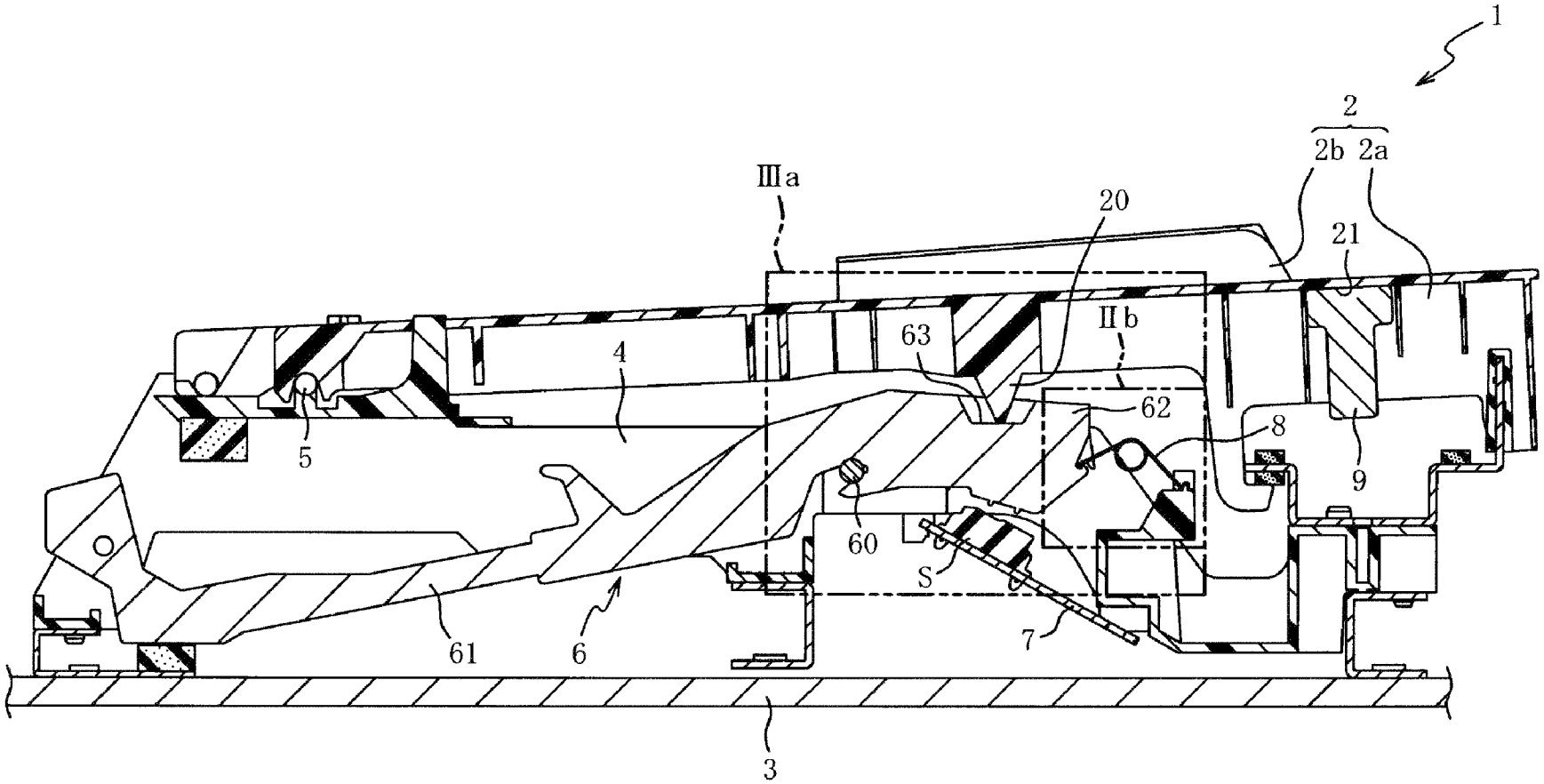
FIG. 1 is a cross-sectional view of a keyboard apparatus according to a first embodiment.

Hereinafter, embodiments are described with reference to the accompanying drawings. First, an overall configuration of a keyboard apparatus 1 of a first embodiment is described with reference to FIG. 1. FIG. 1 is a cross-sectional view of the keyboard apparatus 1 according to the first embodiment. FIG. 1 illustrates a cross section cut along a plane, the plane being orthogonal to a left-right direction (direction in which multiple keys 2 are arranged side by side) of the keyboard apparatus 1 and including a hammer 6 and a white key 2*a*. In the following description, a front side (right side in FIG. 1) as viewed from a performer is described as the front side of the keyboard apparatus 1, and the opposite side (left side in FIG. 1) is described as the rear side.

As shown in FIG. 1, the keyboard apparatus 1 is configured as a keyboard instrument (electronic piano) including multiple (88 in the present embodiment) keys 2 formed of a resin material. The keys 2 include multiple (52 in the present embodiment) white keys 2*a* for playing natural notes, and multiple (36 in the present embodiment) black keys 2*b* for playing derived notes. These white keys 2*a* and black keys 2*b* are provided side by side in the left-right direction (direction perpendicular to the paper surface of FIG. 1).

In the keyboard apparatus 1, a plate-shaped chassis 3 formed of a synthetic resin, a steel plate, or the like is provided so as to extend in the left-right direction. A base member 4 for supporting the keys 2 is fixed on an upper surface of the chassis 3.

A shaft 5 serving as a rotating shaft for the keys 2 is provided on an upper surface on a rear end side (left side in FIG. 1) of the base member 4. By the shaft 5, a rear end (base end) portion of the keys 2 is rotatably supported by the base member 4. Below the keys 2, the hammer 6 interlocked with rotation of the keys 2 is provided. The hammer 6 gives the performer a feel (hereinafter referred to as "key pressing feel") when the keys 2 are pressed.

A structure in which the hammer 6 (which gives the key pressing feel) is rotated in conjunction with pressing or releasing of the white key 2*a* is described in detail below, and substantially the same structure also applies to the black key 2*b*. Therefore, the action and effect of the configuration of the white key 2*a* described below are similarly exhibited in the black key 2*b*.

The hammer 6 is rotatably supported about a rotating shaft 60 along the left-right direction in a substantially central portion of the base member 4 in a front-rear direction. The hammer 6 includes a mass part 61 (mass body) for giving the key pressing feel when the white key 2*a* is pressed, and a pressing part 62 for pushing a switch S when the white key 2*a* is pressed.

In the hammer 6, a portion on the rear side (left side in FIG. 1) (one end side) of the rotating shaft 60 is the mass part 61, and a portion on the front side (right side in FIG. 1) (other end side) of the rotating shaft 60 is the pressing part 62. On an upper surface of the pressing part 62, a receiving part 63 recessed downward is formed.

A protruding part 20 is formed protruding downward from a lower surface of the white key 2*a*. A tip of the protruding part 20 is in contact with a bottom surface of the receiving part 63 of the hammer 6. The bottom surface of the receiving part 63 is configured as a sliding surface on which the tip of the protruding part 20 slides in the front-rear direction. Therefore, when the white key 2*a* is pressed, by sliding of the protruding part 20 of the white key 2*a* along the bottom surface of the receiving part 63, the hammer 6 rotates about the rotating shaft 60. By rotation of the hammer 6, the mass part 61 is displaced so as to be lifted. Since the mass part 61 has a mass sufficient to give the key pressing feel, by a reaction force accompanying the rotation of the hammer 6, the performer is given the key pressing feel when the white key 2*a* is pressed.

On the other hand, the pressing part 62 is displaced downward when the white key 2*a* is pressed. Since a substrate 7 having the switch S on an upper surface thereof is provided below the pressing part 62, by pressing of the white key 2*a*, the switch S is pushed by the pressing part 62. By on/off of the switch S, key pressing information (note information) of the white key 2*a* is detected, and a musical tone signal is output to the outside based on a detection result.

A state (see FIG. 4B) in which the switch S is pushed by the pressing part 62 is a terminal position (hereinafter referred to as "terminal position") of the white key 2*a* in key pressing. When the white key 2*a* is released from the terminal position, due to the mass of the mass part 61 of the hammer 6, the hammer 6 rotates so as to return to an initial position (state of FIG. 1). When the hammer 6 rotates, the protruding part 20 is lifted while sliding along the bottom surface of the receiving part 63, thereby giving a restoration force that restores the white key 2*a* to the initial position.

In this way, in the present embodiment, the key pressing feel when the white key 2*a* is pressed is given by the hammer 6 (mass part 61). In addition to the hammer 6, an elastic body 8 may also be configured to give the key pressing feel.

Figure 2A:
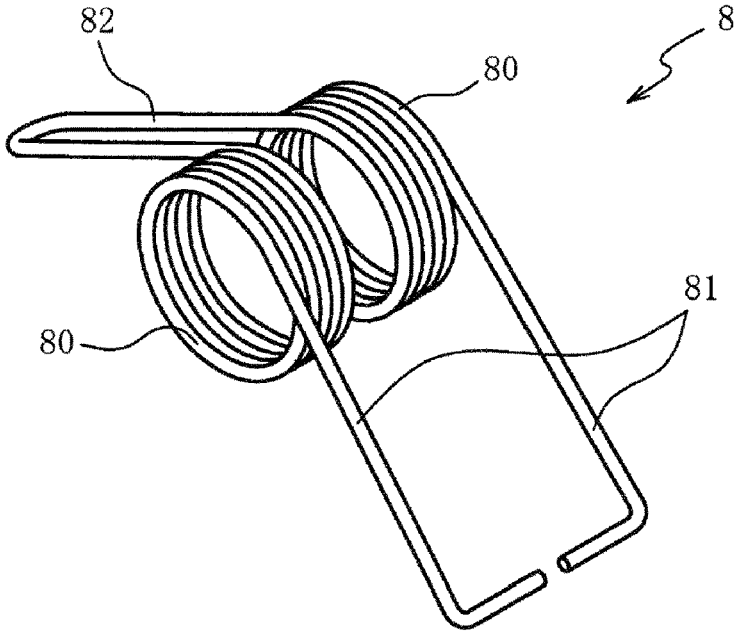
FIG. 2A is a perspective view of an elastic body.
Figure 2B:
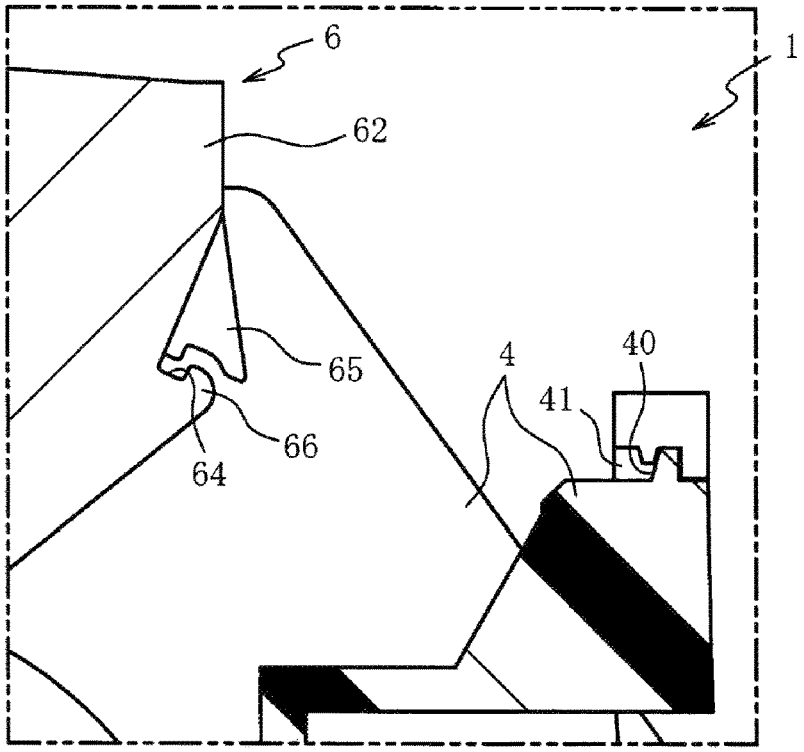
FIG. 2B is a partially enlarged cross-sectional view of the keyboard apparatus, in which portion IIb in FIG. 1 is enlarged.

The elastic body 8 and an attachment structure thereof are described in detail with reference to FIG. 1, FIG. 2A and FIG. 2B. FIG. 2A is a perspective view of the elastic body 8. FIG. 2B is a partially enlarged cross-sectional view of the keyboard apparatus 1, in which portion IIb in FIG. 1 is enlarged. FIG. 2B illustrates a state in which the elastic body 8 has been removed from the keyboard apparatus 1.

As shown in FIG. 2A, the elastic body 8 is a double torsion-shaped helical torsion spring including: a pair of coils 80 arranged side by side in an axial direction; a pair of first arms 81 extending from both end sides in the axial direction of the pair of coils 80; and a second arm 82 extending from an end on a central side in the axial direction of the pair of coils 80. A tip of each of the pair of first arms 81 is formed in an L shape bending toward a gap between the pair of first arms 81. The second arm 82 is formed in a U shape connecting the ends on the central side in the axial direction of the pair of coils 80.

As shown in FIG. 2B, in the base member 4, a recess 40 for supporting the elastic body 8 is formed in a position facing a front end (end on the right side in FIG. 2B) of the pressing part 62 of the hammer 6 in the front-rear direction. The recess 40 is formed so as to be recessed in a direction away from the rotating shaft 60 (see FIG. 1) of the hammer 6. The tips of the pair of first arms 81 of the elastic body 8 are rotatably fitted into the recess 40.

On an outer surface on the front end side of the pressing part 62 of the hammer 6, a recess 64 recessed toward the rotating shaft 60 side (left side in FIG. 2B) of the hammer 6 is formed. The recess 64 is a portion that rotatably receives a tip of the second arm 82 of the elastic body 8.

That is, by fitting the first arm 81 and the second arm 82 that constitute both ends in the front-rear direction of the elastic body 8 into the recess 40 and the recess 64 respectively, both ends of the elastic body 8 are rotatably hooked on the base member 4 and the hammer 6 respectively (see FIG. 1). Accordingly, the elastic body 8 can be rotated in conjunction with rotation of the hammer 6.

A restriction wall 41 restricting the displacement of the elastic body 8 (first arm 81) in the left-right direction (direction perpendicular to the paper surface of FIG. 2B) is formed in the recess 40 of the base member 4. The recess 64 of the hammer 6 is formed by a pair of upper and lower protrusions 65 and 66 protruding from a front end surface of the pressing part 62. Since the protrusion 65 on the upper side is configured to be inserted into an inner peripheral side of the second arm 82 of the elastic body 8, the displacement of the elastic body 8 in the left-right direction is restricted by contact between the protrusion 65 and the second arm 82. In this way, in a state in which the displacement of the elastic body 8 in the left-right direction is restricted, by rotatably connecting both ends of the elastic body 8 to the base member 4 and the hammer 6, the elastic body 8 can be stably rotated.

Figure 3A:
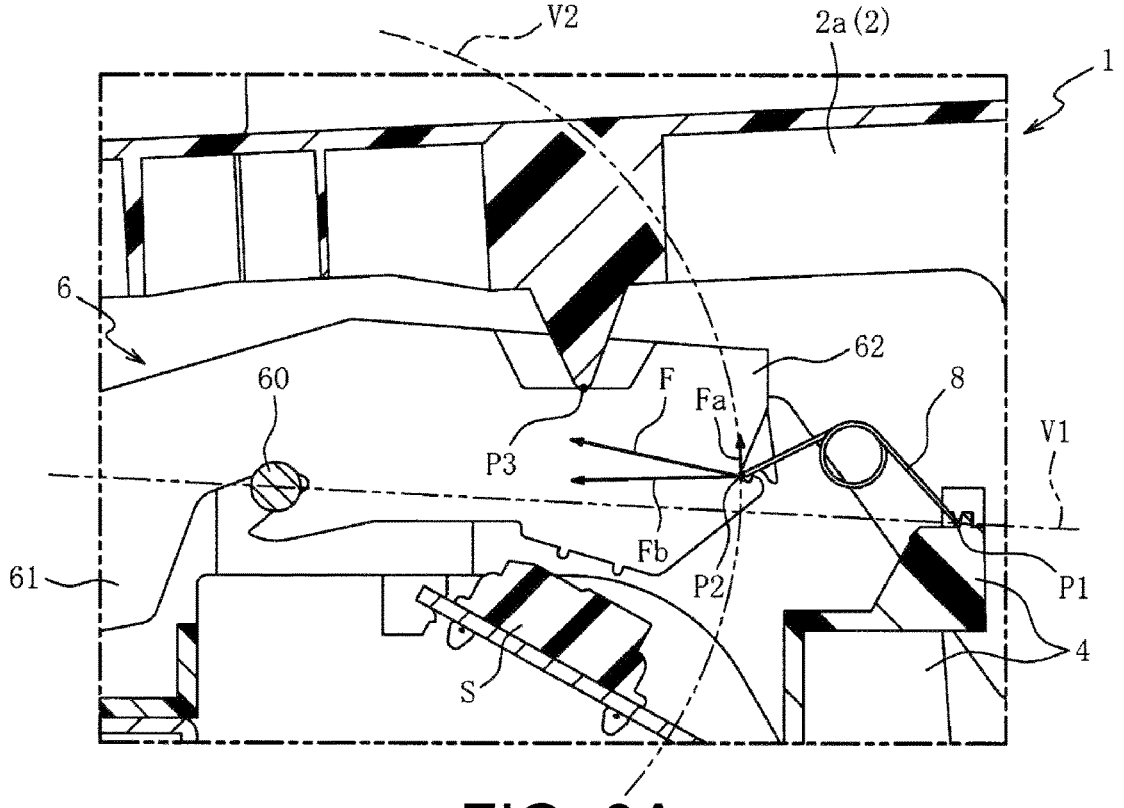
FIG. 3A is a partially enlarged cross-sectional view of the keyboard apparatus, in which portion III*a* in FIG. 1 is enlarged.
Figure 3B:
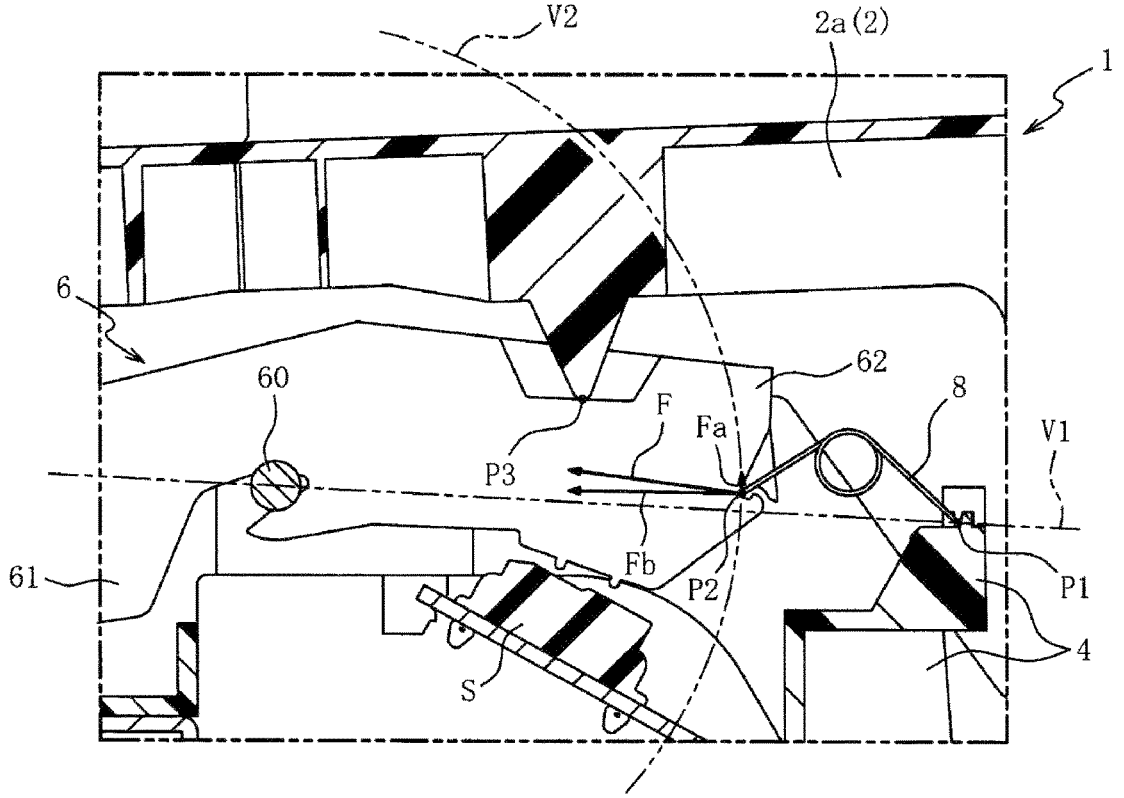
FIG. 3B is a partially enlarged cross-sectional view of the keyboard apparatus, showing a state in which a white key is pressed from the state of FIG. 3A.

Next, with reference to FIG. 3A, FIG. 3B, FIG. 4A and FIG. 4B a load applied to the hammer 6 from the elastic body 8 when the white key 2*a* is pressed or released is described. FIG. 3A is a partially enlarged cross-sectional view of the keyboard apparatus 1, in which portion IIIa in FIG. 1 is enlarged. FIG. 3B is a partially enlarged cross-sectional view of the keyboard apparatus 1, showing a state in which the white key 2*a* is pressed from the state of FIG. 3A.

Figure 4A:
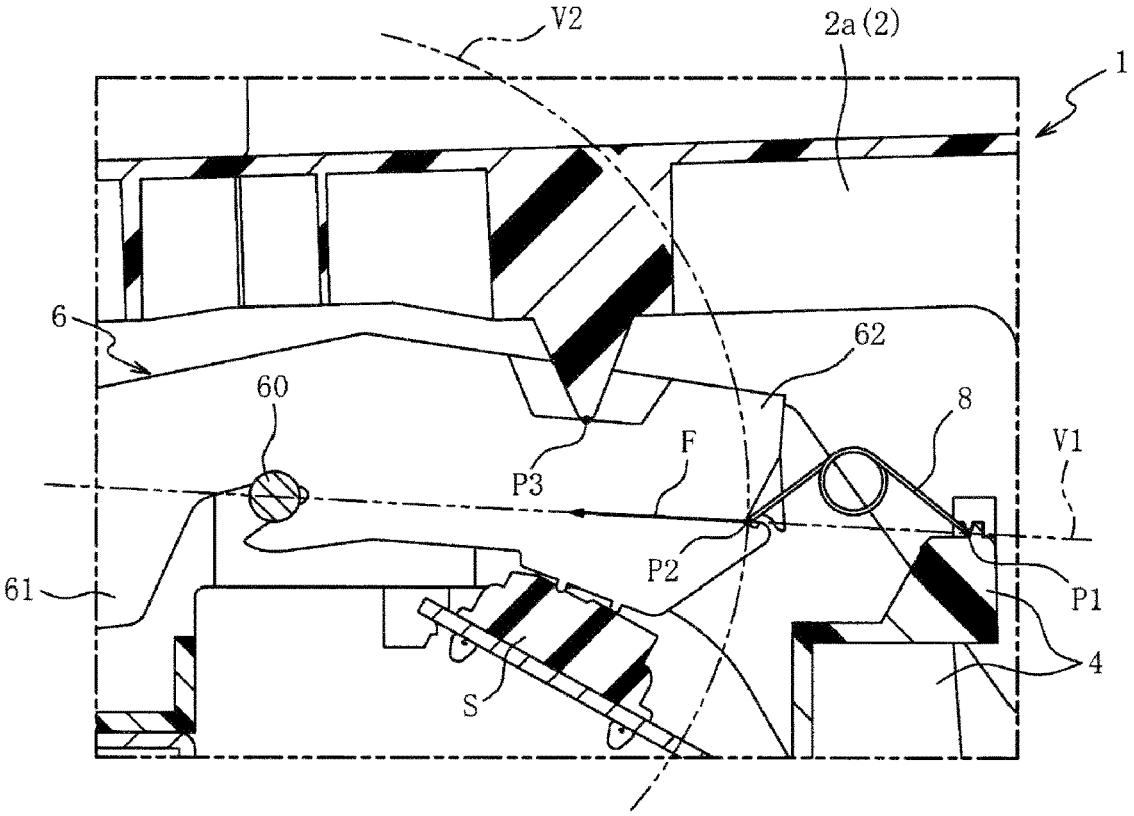
FIG. 4A is a partially enlarged cross-sectional view of the keyboard apparatus, showing a state in which the white key is further pressed from the state of FIG. 3B.
Figure 4B:
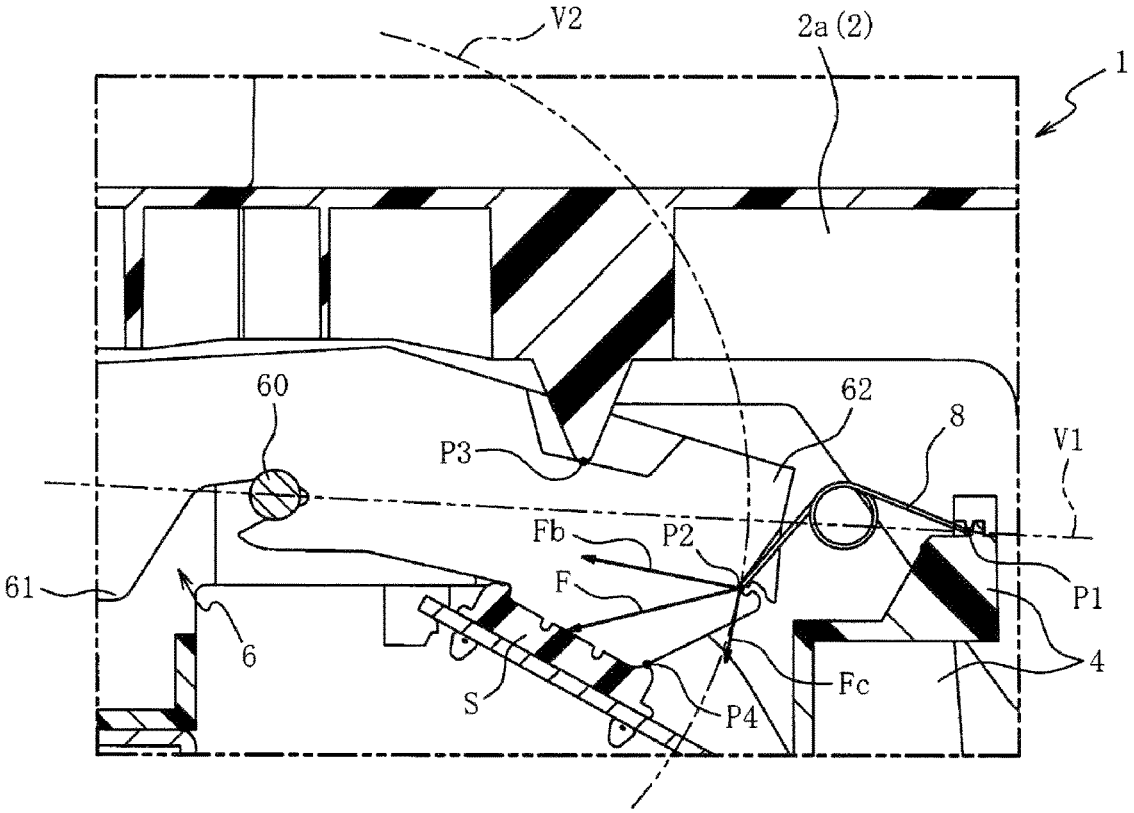
FIG. 4B is a partially enlarged cross-sectional view of the keyboard apparatus, showing a state in which the white key is pressed to a terminal position from the state of FIG. 4A.

FIG. 4A is a partially enlarged cross-sectional view of the keyboard apparatus 1, showing a state in which the white key 2*a* is further pressed from the state of FIG. 3B. FIG. 4B is a partially enlarged cross-sectional view of the keyboard apparatus 1, showing a state in which the white key 2*a* is pressed to the terminal position from the state of FIG. 4A. In FIG. 3A, FIG. 3B, FIG. 4A and FIG. 4B, hatching of the hammer 6 is omitted in order to simplify the drawings.

In the following description, a position (position where the elastic body 8 and the base member 4 are connected) where the elastic body 8 is supported by the base member 4 is described as support position P1, and a position (position where the elastic body 8 and the hammer 6 are connected) where a load is applied to the pressing part 62 of the hammer 6 from the elastic body 8 is described as load application position P2. In a side view (cross-sectional view in a plane orthogonal to the rotating shaft 60 of the hammer 6), a straight line connecting the support position P1 and the center of the rotating shaft 60 of the hammer 6 is described as imaginary line V1, and a circle drawn about the rotating shaft 60 so as to pass through the load application position P2 is described as imaginary circle V2.

As shown in FIG. 3A, the elastic body 8 is in a state of being compressed by a predetermined amount between the base member 4 and the hammer 6 in the initial position before the white key 2*a* is pressed. Therefore, in the elastic body 8, an elastic force F that pushes and extends the base member 4 and the pressing part 62 of the hammer 6 is generated. The direction of the elastic force F is a direction along a straight line connecting the support position P1 and the load application position P2.

Since the load application position P2 is located above the imaginary line V1 in the initial position, in the initial position, the elastic force F toward an obliquely rear upper side (upper-left side in FIG. 3A) is applied to the pressing part 62 of the hammer 6.

If the elastic force F is decomposed into a load Fa being a tangential component of the imaginary circle V2 and a load Fb being a normal component of the imaginary circle V2, the load Fa acts in a direction (second direction) of pushing up the pressing part 62 of the hammer 6. That is, the load Fa is a load felt as a reaction force by the performer when pressing the white key 2*a*. In the following description, this load is described as reaction force load Fa.

As shown in FIG. 3B, when the white key 2*a* is pressed from the initial position, and the load application position P2 is displaced between the initial position and the imaginary line V1 after the key pressing, the elastic body 8 is slightly compressed. The reason is that, if the load application position P2 is displaced on an imaginary circle (not shown) centered on the support position P1, the compression amount of the elastic body 8 is constant; in contrast, in the present embodiment, the load application position P2 is displaced on the imaginary circle V2 centered on the rotating shaft 60 of the hammer 6.

Therefore, when the load application position P2 is displaced between the initial position and the imaginary line V1 after key pressing, the elastic force F acting on the hammer 6 slightly increases as compared with that in the initial position. On the other hand, since the direction of the elastic force F gradually changes so as to become parallel to the imaginary line V1 as a stroke amount of key pressing increases from the initial position, a tangential component (component in the tangential direction of the imaginary circle V2) of the elastic force F decreases as compared with that in the initial position. Since a rate of decrease of the tangential component of the elastic force F is configured to be greater than a rate of increase of the elastic force F, the reaction force load Fa gradually decreases as the stroke amount of the white key 2*a* increases from the initial position.

As shown in FIG. 4A, when the white key 2*a* is further pressed from the state of FIG. 3B and the load application position P2 reaches the imaginary line V1, the direction of the elastic force F acting on the hammer 6 becomes along the imaginary line V1. That is, a state is achieved in which the elastic force F is directed toward the rotating shaft 60 of the hammer 6, and no load is generated in a rotation direction of the hammer 6.

In this way, by gradually decreasing the reaction force load Fa acting on the hammer 6 from the elastic body 8 from the initial position until the middle of key pressing, the key pressing feel in the middle of key pressing can be made lighter than that near the initial position in key pressing. Therefore, a good key pressing feel can be given to the performer as compared with a case where the key pressing feel is given only by the mass (load) of the mass part 61 of the hammer 6.

In the following description, in a state in which the load application position P2 is located on the imaginary line V1, a position (state of FIG. 4A) (predetermined position) where no load is generated by the elastic force F of the elastic body 8 is described as "neutral position."

As shown in FIG. 4B, when the white key 2*a* is further pressed from the neutral position (state of FIG. 4A) and the load application position P2 is displaced below the imaginary line V1, the elastic force F toward an obliquely rear lower side (lower-left side in FIG. 4B) is applied to the hammer 6.

If the elastic force F is decomposed into a load Fc being the tangential component of the imaginary circle V2 and the load Fb being the normal component of the imaginary circle V2, the load Fc acts in a direction (first direction) of pushing down the pressing part 62 of the hammer 6. That is, when the white key 2*a* is pressed, the load Fc is a load that assists the key pressing operation. In the following description, this load is described as auxiliary load Fc.

In the case where the load application position P2 is displaced below the imaginary line V1, the compression on the elastic body 8 is slightly relaxed (the elastic body 8 is slightly elongated) as compared with that in the neutral position. The reason is that, as described above, if the load application position P2 is displaced on the imaginary circle (not shown) centered on the support position P1, the compression amount of the elastic body 8 is constant; in contrast, the load application position P2 is displaced on the imaginary circle V2.

Therefore, when the load application position P2 is displaced below the imaginary line V1, the elastic force F acting on the hammer 6 slightly decreases as compared with that in the neutral position. On the other hand, since the direction of the elastic force F changes so as to form an angle with the imaginary line V1 that gradually increases as the stroke amount of key pressing increases from the initial position, the tangential component of the elastic force F increases as compared with that in the neutral position. Since a rate of increase of the tangential component of the elastic force F is configured to be greater than a rate of decrease of the elastic force F, the auxiliary load Fc gradually increases as the stroke amount of the white key 2*a* increases from the neutral position.

By gradually increasing the auxiliary load Fc acting on the hammer 6 from the neutral position until the terminal position, the key pressing feel near the terminal position can be made lighter than that near the neutral position. Therefore, a good key pressing feel can be given to the performer as compared with the case where the key pressing feel is given only by the load of the mass part 61 of the hammer 6.

In this way, in the present embodiment, in a stroke region from the initial position to the neutral position, the reaction force load Fa that gradually decreases is applied to the hammer 6; in a stroke region from the neutral position to the terminal position, the auxiliary load Fc that gradually increases is applied to the hammer 6. Therefore, when the white key 2*a* is pressed to the terminal position and then released, the auxiliary load Fc gradually decreases as approaching the neutral position (state of FIG. 4A). Accordingly, smooth restoration of the white key 2*a* can be achieved from the terminal position until the neutral position. When the white key 2*a* returns from the neutral position toward the initial position after key releasing, since the reaction force load Fa, that is, the force in the direction of restoring the white key 2*a*, gradually increases, the white key 2*a* can be quickly restored to the initial position.

Here, in the case where the reaction force load Fa or the auxiliary load Fc is applied to the hammer 6 by the elastic body 8, it is also possible to, for example, connect the elastic body 8 between the mass part 61 (see FIG. 1) of the hammer 6 and the base member 4. However, in order to cause the reaction force due to the mass of the mass part 61 to efficiently act on the white key 2*a*, in the hammer 6, a dimension from the rotating shaft 60 to a rear end (one end of the hammer 6) of the mass part 61 is formed longer than a dimension from the rotating shaft 60 to a front end (the other end of the hammer 6) of the pressing part 62. Therefore, when the hammer 6 is rotated as the white key 2*a* is pressed, a vertical displacement amount of the mass part 61 is larger than that of the pressing part 62.

Therefore, when the elastic body 8 is connected to the mass part 61 as described above, for example, a difference between the compression amount (elastic force F) of the elastic body 8 in the initial position and the compression amount of the elastic body 8 in the neutral position is likely to increase. Therefore, it becomes difficult to gradually decrease the reaction force load Fa from the initial position until the neutral position or to gradually increase the auxiliary load Fc from the neutral position until the terminal position (in order to cause such an increase or decrease, it is necessary to increase the size of the elastic body 8 and reduce a rate of change of the elastic force F). Furthermore, when the elastic body 8 is connected to the mass part 61 that is largely displaced up and down, since it is accordingly necessary to secure a large space for displacement of the elastic body 8, limitations are likely to be imposed on the arrangement of other members.

In contrast, in the present embodiment, since the elastic body 8 is connected to the front end of the pressing part 62 of the hammer 6, the elastic body 8 can be connected to a portion of the hammer 6 where the vertical displacement amount is small. Therefore, as compared with the case where the elastic body 8 is connected to the mass part 61, a change in the compression amount (elastic force F) of the elastic body 8 with respect to a change in the stroke amount of key pressing can be reduced. Therefore, by utilizing the elastic body 8 that is relatively small in size, the reaction force load Fa can be gradually decreased or the auxiliary load Fc can be gradually increased. Furthermore, since the space for displacement of the elastic body 8 can be reduced by connecting the elastic body 8 to the pressing part 62 having a smaller vertical displacement amount than the mass part 61, the imposition of limitations on the arrangement of other members can be suppressed.

Assuming that a position where the tip of the protruding part 20 of the white key 2*a* and the receiving part 63 of the hammer 6 contact is a contact position P3, in the present embodiment, a distance from the rotating shaft 60 of the hammer 6 to the load application position P2 is set longer than a distance from the rotating shaft 60 of the hammer 6 to the contact position P3.

That is, the position P2 (force point) where the reaction force load Fa or the auxiliary load Fc is applied to the hammer 6 is set farther from the rotating shaft 60 (fulcrum) of the hammer 6 than the contact position P3 (action point) where the white key 2*a* and the hammer 6 contact. Accordingly, the reaction force load Fa or the auxiliary load Fc acting on the white key 2*a* can be made relatively large. Thus, a relatively large change can be caused in the key pressing feel felt by the performer, or the key pressing feel can be changed by using the elastic body 8 having a relatively small elastic force.

In the elastic body 8, the first arm 81 and the second arm 82 (see FIG. 2A) are respectively rotatably fitted into the recess 40 of the base member 4 and the recess 64 of the hammer 6. From the initial position until the terminal position in key pressing, the elastic force F is generated in the directions in which the first arm 81 and the second arm 82 of the elastic body 8 respectively enter the recess 40 and the recess 64. Since the reaction force load Fa or the auxiliary load Fc is applied to the hammer 6 by the elastic force F, when the elastic body 8 rotates in conjunction with the hammer 6, the elastic body 8 can be prevented from falling off from the recess 40 and the recess 60 by the elastic force F of the elastic body 8 itself.

That is, since the first arm 81 and the second arm 82 of the elastic body 8 can simply be hooked into the recess 40 and the recess 60 without the need to be rotatably connected to the base member 4 and the hammer 6 (and there is no need to separately provide a part that allows the elastic body 8 to fall off from the recess 40 and the recess 60), the elastic body 8 can be easily attached to and detached from the base member 4 and the hammer 6. Therefore, workability in maintenance of the hammer 6 or the elastic body 8 can be improved.

Here, as described above, in the present embodiment, the key pressing of the white key 2*a* is configured to be detected by the fact that the switch S (which is of a contact type) is pushed by the pressing part 62 of the hammer 6. When the switch S is pushed, since the performer feels a reaction force from the switch S, there is a fear that the key pressing feel may be reduced. In contrast, the present embodiment has a configuration capable of suppressing such reduction in the key pressing feel. This configuration is further described with reference to FIG. 5A and FIG. 5B.

Figure 5A:
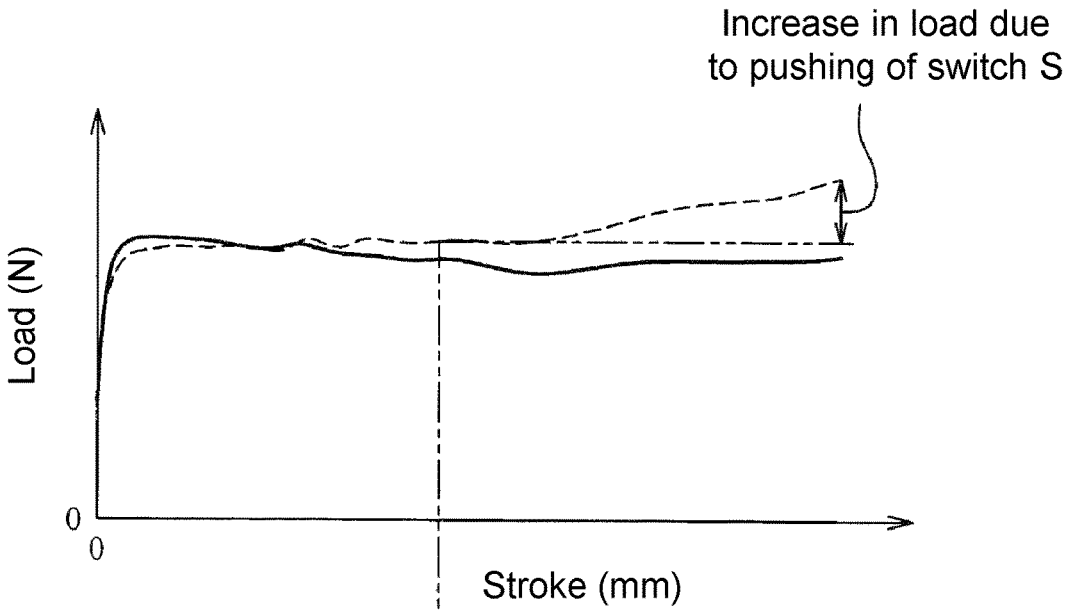
FIG. 5A is a graph showing a relationship between a stroke amount of a white key and a load acting on the white key.
Figure 5B:
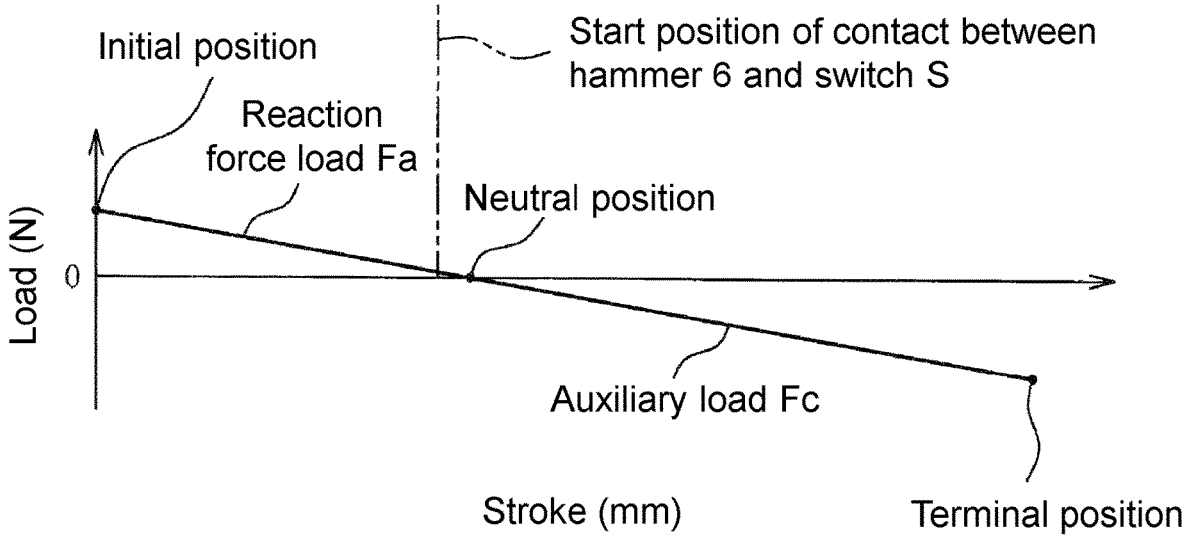
FIG. 5B is a graph showing a relationship between the stroke amount of the white key and a load applied to a hammer.

FIG. 5A is a graph showing a relationship between the stroke amount of the white key 2*a* and a load acting on the white key 2*a*. FIG. 5B is a graph showing a relationship between the stroke amount of the white key 2*a* and a load applied to the hammer 6.

In FIG. 5A, the load (the reaction force felt by the performer during key pressing) acting on the white key 2*a* in the case where the elastic body 8 and a later-described weight 9 (see FIG. 1) are provided is illustrated by a solid line, and the load acting on the white key 2*a* in the case where the elastic body 8 and the weight 9 are not provided is illustrated by a broken line. In FIG. 5B, in order to facilitate understanding, a change in the load applied to the hammer 6 from the elastic body 8 is schematically shown by a straight line.

As shown by the broken line in FIG. 5A, in the case where the elastic body 8 is not provided, after the hammer 6 and the switch S start to contact each other, the load acting on the white key 2*a* gradually increases as the stroke amount of the white key 2*a* increases. This increase in load is due to the reaction force generated when the switch S is pushed.

On the other hand, in the present embodiment, since the elastic body 8 is provided, as shown in FIG. 5B, during a period during which the switch S is pushed by the hammer 6, the reaction force load Fa is configured to decrease as the stroke amount of the white key 2*a* increases, or the auxiliary load Fc is configured to increase as the stroke amount of the white key 2*a* increases. Accordingly, since the performer is less likely to feel the reaction force from the switch S, a good key pressing feel can be given to the performer.

More specifically, since the hammer 6 and the switch S are configured to start to contact each other in the vicinity of the neutral position, during the period during which the switch S is pushed by the hammer 6, the auxiliary load Fc that assists the pushing is able to act on the hammer 6. Accordingly, since an increase in the reaction force due to pushing of the switch S can be canceled out by the auxiliary load Fc, the performer can be prevented from feeling the reaction force from the switch S. Therefore, even in the case where the key pressing of the white key 2*a* is detected by the switch S of the contact type, a key pressing feel close to that of an acoustic piano can be given.

Furthermore, by causing the contact between the hammer 6 and the switch S to start in the vicinity of the neutral position, a timing at which the load acting on the hammer 6 is switched from the reaction force load Fa to the auxiliary load Fc can be made substantially coincident with a timing at which the reaction force from the switch S increases. Therefore, in stroke regions before and after the hammer 6 and the switch S start to contact each other, since the load acting on the white key 2*a* can be easily made constant, a good key pressing feel can be given to the performer. The "vicinity of the neutral position" is a range in which the stroke amount of the white key 2*a* from the neutral position is ±1 mm.

In the present embodiment, the hammer 6 and the switch S are configured to start to contact each other when the stroke amount of the white key 2*a* is smaller than that in the neutral position. However, the hammer 6 and the switch S may also be configured to start to contact each other, for example, when the stroke amount of the white key 2*a* is greater than that in the neutral position. According to this configuration, when the pushing of the switch S is started, the auxiliary load Fc that cancels out the reaction force from the switch S can be reliably applied to the hammer 6.

In a contact portion between the hammer 6 and the switch S, assuming that a portion farthest from the rotating shaft 60 of the hammer 6 is a contact position P4 (see FIG. 4B), in the present embodiment, the distance from the rotating shaft 60 of the hammer 6 to the load application position P2 is set longer than a distance from the rotating shaft 60 of the hammer 6 to the contact position P4.

That is, the position P2 (force point) where the auxiliary load Fc is applied to the hammer 6 is set farther from the rotating shaft 60 (fulcrum) of the hammer 6 than the contact position P4 (action point) where the hammer 6 and the switch S contact. Accordingly, a pushing force on the switch S by the auxiliary load Fc can be made relatively large. Thus, the reaction force from the switch S can be made less likely to be felt, or the reaction force from the switch S can be canceled out by using the elastic body 8 having a relatively small elastic force.

Here, since the key pressing feel felt by the performer is greatest when the white key 2*a* is pressed in a stationary state, in order to give a good key pressing feel, it is important to adjust the magnitude of the reaction force acting on the white key 2*a* in the initial position. In order to adjust the reaction force, for example, it is also possible to change the elastic force F (spring constant) of the elastic body 8 and adjust the magnitude of the reaction force load Fa (see FIG. 3A) generated in the white key 2*a* in the initial position.

However, when the elastic force F (spring constant) of the elastic body 8 is changed, not only the magnitude of the reaction force load Fa in the initial position, but also the amount of increase/decrease (the slope of the straight line shown in FIG. 5B) in the reaction force load Fa or the auxiliary load Fc from the initial position until the terminal position may change. Therefore, a desired key pressing feel may not be able to be given.

In contrast, in the present embodiment, since the weight 9 (see FIG. 1) that adjusts the reaction force load Fa in the initial position is provided, by adjusting the mass of the weight 9, the reaction force acting on the white key 2*a* in the initial position can be adjusted without changing the amount of increase/decrease in the reaction force load Fa or the auxiliary load Fc from the initial position until the terminal position. Therefore, the key pressing feel can be easily adjusted to correspond to the performer's preference.

As in the present embodiment, when the reaction force load Fa is generated in the initial position, the key pressing feel near the initial position may become excessively heavy. Therefore, for example, by forming the weight 9 with a mass that applies a load of the same magnitude as the reaction force load Fa, the key pressing feel near the initial position can be prevented from becoming excessively heavy. Furthermore, by removing the weight 9, a heavy key pressing feel can be given by the reaction force load Fa acting on the hammer 6 in the initial position.

A recess 21 is formed on a lower surface on the front end (tip) side (compared with the center in the front-rear direction) of the white key 2*a*. Since the weight 9 is accommodated in the space of the recess 21, the imposition of limitations on the arrangement of other members can be suppressed. Furthermore, by providing the weight 9 on the front end side of the white key 2*a*, that is, in a position away from the shaft 5 being a rotation center of the white key 2*a*, the moment of inertia of the white key 2*a* itself can be increased. Therefore, a relatively great key pressing feel can be given by the weight 9 (a desired key pressing feel can be given by the weight 9 having a relatively small mass).

Next, a keyboard apparatus 201 according to a second embodiment is described with reference to FIG. 6A and FIG. 6B. The first embodiment has described the case where the reaction force load Fa or the auxiliary load Fc is applied to the hammer 6 by the elastic force F of the elastic body 8. In contrast, the second embodiment describes a case where a load is applied to the hammer 6 by a repulsive force F of a pair of magnets 208*a* and 208*b*. The same portions as those in the first embodiment are denoted by the same reference numerals and descriptions thereof are omitted.

Figure 6A:
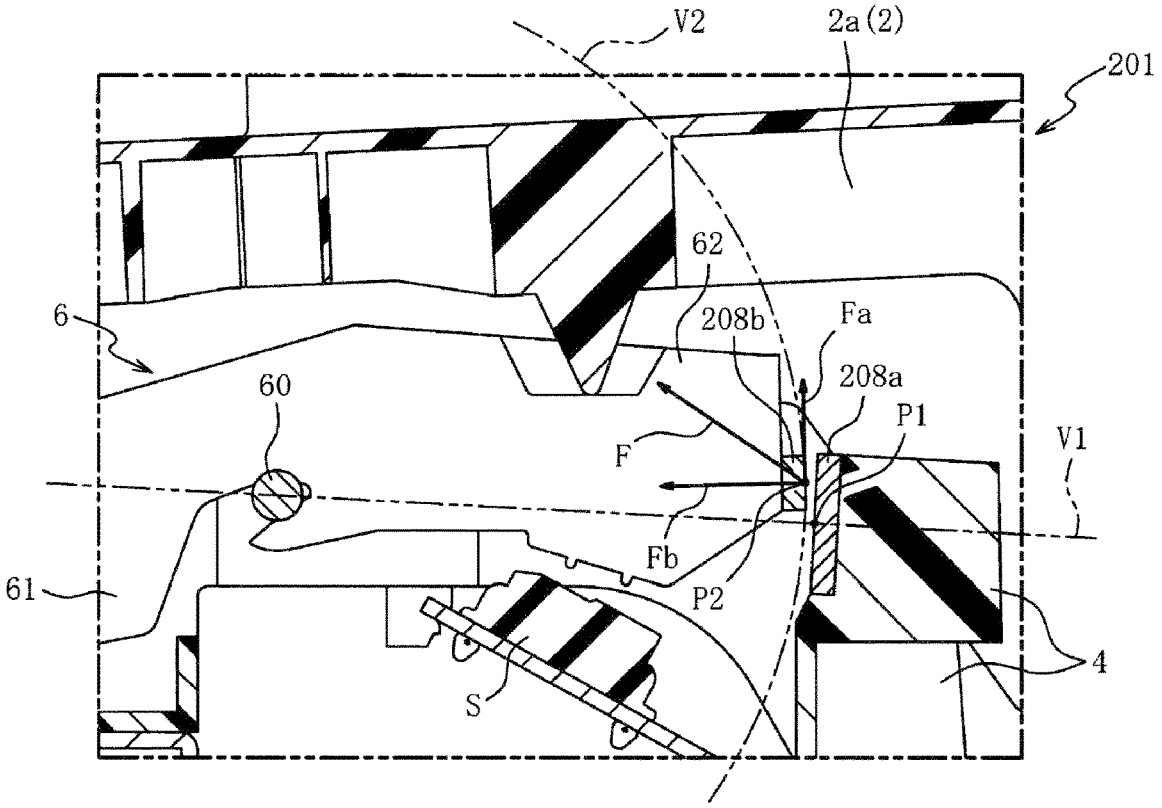
FIG. 6A is a partially enlarged cross-sectional view of a keyboard apparatus of a second embodiment.

FIG. 6A is a partially enlarged cross-sectional view of the keyboard apparatus 201 of the second embodiment. FIG. 6B is a partially enlarged cross-sectional view of the keyboard apparatus 201, showing a state in which the white key 2*a* is pressed from the state of FIG. 6A. FIG. 6A and FIG. 6B illustrate cross sections of portions corresponding to those of FIG. 3A, FIG. 3B, FIG. 4A and FIG. 4B, and omit hatching of the hammer 6 similarly to FIG. 3A, FIG. 3B, FIG. 4A and FIG. 4B. In FIG. 6A, the direction of the repulsive force F of the magnets 208*a* and 208*b* is schematically illustrated.

As shown in FIG. 6A, the keyboard apparatus 201 of the second embodiment includes the pair of magnets 208*a* and 208*b* for giving the key pressing feel when the white key 2*a* is pressed. The magnet 208*a* is fixed to the base member 4 in a posture with a magnetic pole directed toward the rotating shaft 60 of the hammer 6. The magnet 208*b* is fixed to the front end surface of the pressing part 62 of the hammer 6 in a posture with the same magnetic pole as that of the magnet 208*a* directed toward the magnet 208*a* side. Therefore, the repulsive force F is generated in each of the pair of magnets 208*a* and 208*b*.

In the following description, on magnetic pole surfaces of the magnets 208*a* and 208*b* that face each other, the center of the magnetic pole surface of the magnet 208*a* is described as center position P1, and the center of the magnetic pole surface of the magnet 208*b* is described as load application position P2. A straight line connecting the center position P1 and the center of the rotating shaft 60 of the hammer 6 is described as imaginary line V1, and a state (state of FIG. 6B) in which the load application position P2 is located on the imaginary line V1 is described as "neutral position."

The load application position P2 is located above the imaginary line V1 in the initial position. Therefore, in the initial position, the repulsive force F toward the obliquely rear upper side (upper-left side in FIG. 6A) is applied to the pressing part 62 of the hammer 6. If the repulsive force F is decomposed into the load Fa being the tangential component of the imaginary circle V2 and the load Fb being the normal component of the imaginary circle V2, the load Fa is the reaction force load Fa.

When the load application position P2 (magnet 208*b*) is displaced between the initial position and the imaginary line V1 after the white key 2*a* is pressed, the magnet 208*b* is displaced so that the centers of the magnetic pole surfaces of the magnets 208*a* and 208*b* approach each other. Therefore, in the middle of such displacement, the repulsive force F slightly increases as compared with that in the initial position. However, a rate of decrease of the tangential component of the repulsive force F is configured to be greater than a rate of increase of the repulsive force F. Therefore, the reaction force load Fa generated by the repulsive force F gradually decreases as the stroke amount of the white key 2*a* increases from the initial position.

Figure 6B:
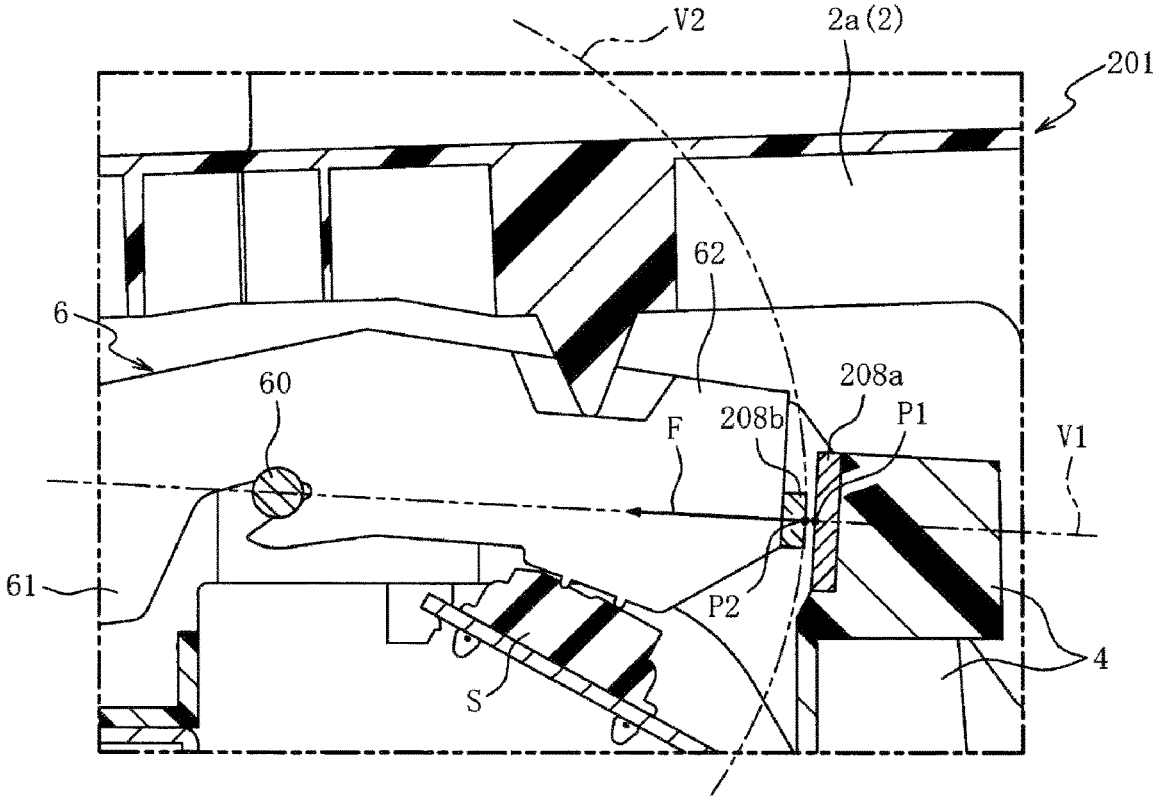
FIG. 6B is a partially enlarged cross-sectional view of the keyboard apparatus, showing a state in which a white key is pressed from the state of FIG. 6A.

As shown in FIG. 6B, when the load application position P2 reaches the imaginary line V1, the centers of the magnetic pole surfaces of the pair of magnets 208*a* and 208*b* face each other, and the direction of the repulsive force F acting on the hammer 6 becomes along the imaginary line V1. That is, a state is achieved in which the repulsive force F is directed toward the rotating shaft 60 of the hammer 6, and no load is generated in the rotation direction of the hammer 6.

In this way, by gradually decreasing the reaction force load Fa acting on the hammer 6 from the initial position until the middle of key pressing, the key pressing feel in the middle of key pressing can be made lighter than that near the initial position. Therefore, a good key pressing feel can be given to the performer.

Although not shown, when the white key 2*a* is further pressed from the neutral position (state of FIG. 6B) and the load application position P2 is displaced below the imaginary line V1, a repulsive force toward the obliquely rear lower side, that is, an auxiliary load that assists the key pressing operation, is applied to the hammer 6. Since this auxiliary load is configured to gradually increase from the neutral position until the terminal position as in the first embodiment, the key pressing feel near the terminal position can be made lighter than that near the neutral position. Therefore, a good key pressing feel can be given to the performer.

On the other hand, when the white key 2*a* is released after key pressing, since the auxiliary load gradually decreases as approaching the neutral position (state of FIG. 6B), smooth restoration of the white key 2*a* can be achieved. When the white key 2*a* returns from the neutral position toward the initial position, since the reaction force load Fa gradually increases, the white key 2*a* can be quickly restored to the initial position.

Next, modifications of the first and second embodiments are described with reference to FIG. 7A and FIG. 7B. The first and second embodiments have described the case where the reaction force load Fa is applied to the hammer 6 from the initial position until the neutral position in key pressing and the auxiliary load Fc is applied to the hammer 6 from the neutral position until the terminal position. In contrast, a first modification describes a case where the reaction force load Fa acts on the hammer 6 from the initial position until the terminal position, and a second modification describes a case where the auxiliary load Fc acts on the hammer 6 from the initial position until the terminal position.

Figure 7A:
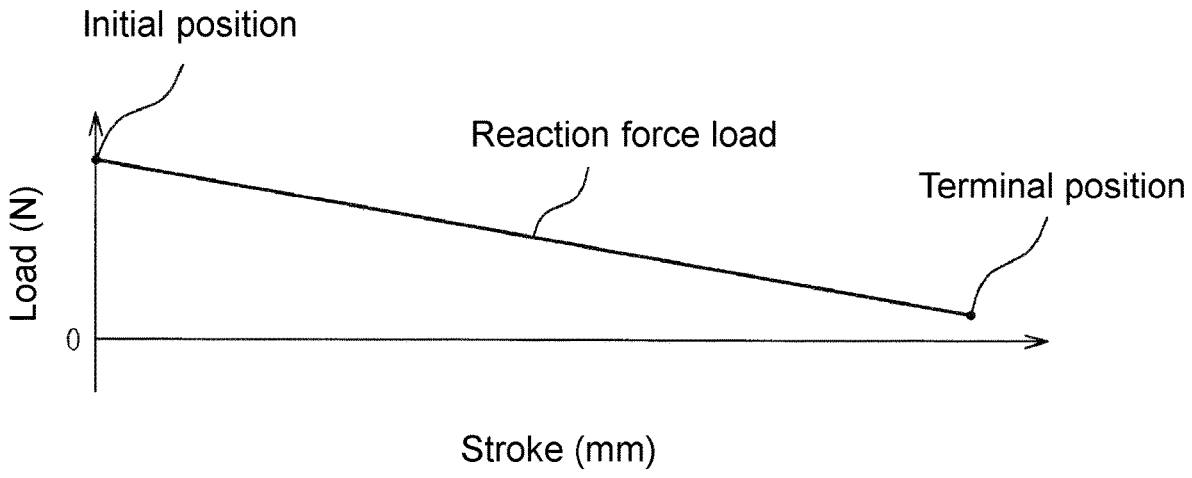
FIG. 7A is a graph showing a relationship between the stroke amount of the white key and the load applied to the hammer according to a first modification.

FIG. 7A is a graph showing a relationship between the stroke amount of the white key 2*a* and the load applied to the hammer 6 during key pressing according to the first modification. FIG. 7B is a graph showing a relationship between the stroke amount of the white key 2*a* and the load applied to the hammer 6 during key pressing according to the second modification. In FIG. 7A and FIG. 7B, in order to facilitate understanding, a change in the load applied to the hammer 6 is schematically shown by a straight line.

As shown in FIG. 7A, in the first modification, a reaction force load that gradually decreases is applied to the hammer 6 from the initial position until the terminal position. For this configuration, for example, the arrangement of the elastic body 8 or the magnets 208*a* and 208*b* may be adjusted so that the load application position P2 in the first embodiment and the second embodiment is always displaced above the imaginary line V1 from the initial position until the terminal position.

According to the first modification, when the white key 2*a* is pressed, since the reaction force load gradually decreases from the initial position until the terminal position, while a heavy key pressing feel is given near the initial position, the key pressing feel can be made lighter near the terminal position than that in the initial position. Therefore, a good key pressing feel can be given to the performer. When the white key 2*a* is released from the terminal position, since the reaction force load gradually increases from the terminal position until the initial position, a feeling that the white key 2*a* sticks to the finger can be given when the white key 2*a* is released, or the white key 2*a* can be quickly restored to the initial position and repeated key striking performance can be improved.

Figure 7B:
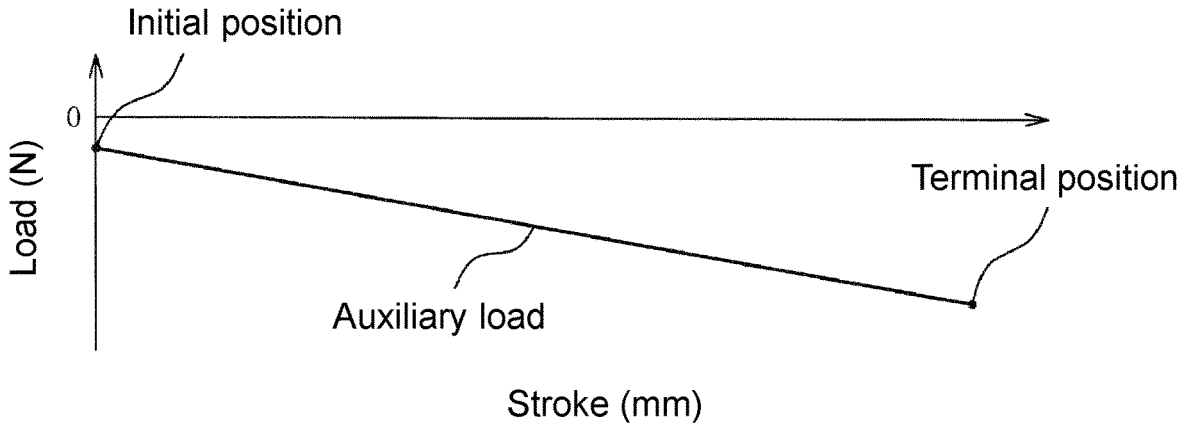
FIG. 7B is a graph showing a relationship between the stroke amount of the white key and the load applied to the hammer according to a second modification.

As shown in FIG. 7B, in the second modification, an auxiliary load that gradually increases is applied to the hammer 6 from the initial position until the terminal position. For this configuration, for example, the arrangement of the elastic body 8 or the magnets 208*a* and 208*b* may be adjusted so that the load application position P2 in the first embodiment and the second embodiment is always displaced below the imaginary line V1 from the initial position until the terminal position.

According to the second modification, when the white key 2*a* is pressed, since the auxiliary load gradually increases from the initial position until the terminal position, while a light key pressing feel is given near the initial position, the key pressing feel can be made particularly light near the terminal position. Therefore, a good key pressing feel can be given to the performer. When the white key 2*a* is released from the terminal position, since the auxiliary load gradually decreases from the terminal position until the initial position, smooth restoration of the white key 2*a* can be achieved from the terminal position until the initial position. Since the second modification has a configuration in which the auxiliary load always acts and no reaction force load is generated in the initial position, for example, the key pressing feel in the initial position can be lightened without using the weight 9 described above.

The disclosure has been described above on the basis of the embodiments. However, as can be easily understood, the disclosure is not limited in any way to the above embodiments, and various modifications or alterations may be made without departing from the spirit of the disclosure.

The above embodiments have described the case where a base end side of the key 2 is axially supported by the shaft 5. However, the disclosure is not limited thereto. For example, the key 2 may be connected to the base member 4 via a hinge (plate-shaped member), and the key 2 may be rotated (swung) by elastic deformation of the hinge, or rotation (swing) of the key 2 may be guided by a link or the like. That is, since the technical idea of the above embodiments is applicable if the hammer 6 is configured to rotate with displacement of the key 2 during key pressing, the structure for displacement of the key 2 is not limited to the above-described forms.

In the above embodiments, the elastic body 8 being a double torsion spring or the magnets 208*a* and 208*b* have been described as examples of the load application member that applies a load to the hammer 6. However, the disclosure is not limited thereto. For example, other elastic bodies such as a leaf spring or a coil spring may be used as the load application member. That is, a known configuration can be adopted by the load application member if the reaction force load Fa or the auxiliary load Fc described in the above embodiments can be applied to the hammer 6.

The above embodiments have described the case where the load from the load application member (the elastic body 8 or the magnets 208*a* and 208*b*) is applied to the pressing part 62 of the hammer 6. However, the disclosure is not limited thereto. For example, the load from the load application member may be configured to be applied to the mass part 61 of the hammer 6. That is, if the reaction force load Fa can be gradually decreased or the auxiliary load Fc can be gradually increased as approaching the terminal position in key pressing, the arrangement (position where the load is applied to the hammer 6) of the load application member can be appropriately set.

The above embodiments have described the configuration in which the switch S is pushed by the hammer 6. However, the switch S may also be configured to be pushed by the key 2. Even in such a configuration, it is preferable that the reaction force load Fa is configured to gradually decrease or the auxiliary load Fc is configured to gradually increase during the period during which the switch S is pushed. Accordingly, the reaction force from the switch S can be made less likely to be felt. Key pressing of the key 2 may be configured to be detected by a non-contact type sensor instead of the switch S.

The above embodiments have described the case where the load of the load application member (the elastic body 8 or the magnets 208*a* and 208*b*) is applied to the position P2 at a farther distance from the rotating shaft 60 of the hammer 6 than a distance between the contact position P3 where the key 2 and the hammer 6 contact and the rotating shaft 60 of the hammer 6. However, the disclosure is not limited thereto. For example, the load from the load application member may be configured to be applied to a position closer to the rotating shaft 60 of the hammer 6 than a distance between the contact position P3 where the key 2 and the hammer 6 contact and the rotating shaft 60 of the hammer 6.

The above embodiments have described the case where the load from the load application member (the elastic body 8 or the magnets 208*a* and 208*b*) is applied to the position P2 at a farther distance from the rotating shaft 60 of the hammer 6 than a distance between the contact position P4 where the hammer 6 and the switch S contact and the rotating shaft 60 of the hammer 6. However, the disclosure is not limited thereto. For example, the load from the load application member may be configured to be applied to a position closer to the rotating shaft 60 of the hammer 6 than a distance between the contact position P4 where the hammer 6 and the switch S contact and the rotating shaft 60 of the hammer 6.

The above embodiments have described the case where the weight 9 for adjusting the magnitude of the reaction force load Fa in the initial position is attached to the tip side of the key 2. However, the disclosure is not limited thereto. For example, the weight 9 may be attached to the pressing part 62 of the hammer 6. The reaction force load Fa may also be adjusted by further providing other load application members (the elastic body 8 or the magnets 208*a* and 208*b*) instead of the weight 9. As described above, the weight 9 may also be omitted.

What is claimed is:

1. A keyboard apparatus, comprising:

a hammer, having a mass body on one end side, rotating in a first direction by being pushed on an other end side when a key is pressed; and a load application member, applying, to the hammer, at least one of a first load directed in the first direction and a second load directed in a second direction opposite the first direction, wherein the first load is a load that gradually increases as approaching a terminal position of the key in key pressing, and the second load is a load that gradually decreases as approaching the terminal position;

wherein the load application member is a spring, or the load application member is a magnet.

2. The keyboard apparatus according to claim 1, further comprising:

a switch, pushed by the key or the hammer during key pressing, wherein during a period during which the switch is pushed by the key or the hammer, the first load or the second load is applied to the hammer.

3. The keyboard apparatus according to claim 2, wherein during the period during which the switch is pushed by the key or the hammer, the first load is applied to the hammer.

4. The keyboard apparatus according to claim 3, wherein the switch is pushed by the hammer, and the first load is applied to the hammer in a position at a farther distance from a rotating shaft of the hammer than a distance between a contact position where the hammer and the switch contact and the rotating shaft of the hammer.

5. The keyboard apparatus according to claim 1, wherein the first load is applied to the hammer from an initial position before the key is pressed until the terminal position.

6. The keyboard apparatus according to claim 1, wherein the second load is applied to the hammer in an initial position before the key is pressed.

7. The keyboard apparatus according to claim 6, wherein the second load is applied to the hammer from the initial position until a predetermined position in the middle of the key pressing, and the first load is applied to the hammer from the predetermined position until the terminal position.

8. The keyboard apparatus according to claim 6, wherein the second load is applied to the hammer from the initial position until the terminal position.

9. The keyboard apparatus according to claim 6, further comprising:

a weight for adjusting the second load applied to the hammer in the initial position.

10. The keyboard apparatus according to claim 9, wherein a recess accommodating the weight is formed on a lower surface on a tip side of the key.

11. The keyboard apparatus according to claim 1, wherein a dimension from a rotating shaft of the hammer to one end of the hammer is formed longer than a dimension from the rotating shaft of the hammer to an other end of the hammer, and the first load or the second load is applied to the other end of the hammer.

12. The keyboard apparatus according to claim 11, wherein the first load or the second load is applied to the hammer in a position at a farther distance from the rotating shaft of the hammer than a distance between a contact position where the key and the hammer contact and the rotating shaft of the hammer.

13. The keyboard apparatus according to claim 1, further comprising:

a base member, rotatably supporting the hammer, wherein the load application member is configured as the spring whose both ends are respectively rotatably connected to the base member and the hammer, a recess into which the end of the load application member is rotatably fitted is formed on an outer surface of the hammer, and the first load or the second load is generated by an elastic force in a direction in which the end of the load application member enters the recess of the hammer from an initial position before the key is pressed until the terminal position.

14. A load application method for a keyboard apparatus, the keyboard apparatus comprising a hammer that has a mass body on one end side, rotates in a first direction by being pushed on an other end side when a key is pressed, and a load application member that applies, to the hammer, at least one of a first load directed in the first direction and a second load directed in a second direction opposite the first direction, wherein the first load is a load that gradually increases as approaching a terminal position of the key in key pressing, and the second load is a load that gradually decreases as approaching the terminal position;

wherein the load application member is a spring, or the load application member is a magnet.

15. The load application method according to claim 14, wherein the keyboard apparatus further comprises a switch pushed by the key or the hammer during key pressing, and the load application method comprises:

applying the first load or the second load to the hammer by the load application member during a period during which the switch is pushed by the key or the hammer.

16. The load application method according to claim 15, comprising:

applying the first load to the hammer by the load application member during the period during which the switch is pushed by the key or the hammer.

17. The load application method according to claim 16, wherein the switch is pushed by the hammer, and the load application method comprises:

applying the first load to the hammer by the load application member in a position at a farther distance from a rotating shaft of the hammer than a distance between a contact position where the hammer and the switch contact and the rotating shaft of the hammer.

18. The load application method according to claim 14, comprising:

applying the first load to the hammer by the load application member from an initial position before the key is pressed until the terminal position.

19. The load application method according to claim 14, comprising:

applying the second load to the hammer by the load application member in an initial position before the key is pressed.

20. The load application method according to claim 19, comprising:

applying the second load to the hammer by the load application member from the initial position until a predetermined position in the middle of the key pressing, and applying the first load to the hammer by the load application member from the predetermined position until the terminal position.

* * * * *